US012465122B2

(12) United States Patent
Yiagidis

(10) Patent No.: US 12,465,122 B2
(45) Date of Patent: Nov. 11, 2025

(54) METHOD OF GEM COMPOSITION FOR THE MANUFACTURE OF JEWELLERY (CRYSTAL IN CRYSTAL)

(71) Applicant: Adamantios J. Yiagidis, Athens (GR)

(72) Inventor: Adamantios J. Yiagidis, Athens (GR)

( * ) Notice: Subject to any disclaimer, the term of this patent is extended or adjusted under 35 U.S.C. 154(b) by 0 days.

(21) Appl. No.: 18/277,633

(22) PCT Filed: Feb. 15, 2022

(86) PCT No.: PCT/GR2022/000006
§ 371 (c)(1),
(2) Date: Aug. 17, 2023

(87) PCT Pub. No.: WO2022/175698
PCT Pub. Date: Aug. 25, 2022

(65) Prior Publication Data

US 2024/0130490 A1 Apr. 25, 2024
US 2024/0225214 A9 Jul. 11, 2024

(30) Foreign Application Priority Data

Feb. 17, 2021 (GR) ..... 20210100103

(51) Int. Cl.
*A44C 17/02* (2006.01)

(52) U.S. Cl.
CPC ..... *A44C 17/02* (2013.01)

(58) Field of Classification Search
CPC ..... A44C 17/02; A44C 17/04; A44C 17/0225; A44C 17/0291
See application file for complete search history.

(56) References Cited

U.S. PATENT DOCUMENTS 4,819,453 A * 4/1989 McNamara ..... A44C 17/04 63/26
9,398,792 B2 * 7/2016 Liao ..... G04B 45/0069
(Continued)

FOREIGN PATENT DOCUMENTS

CN 201032881 Y * 3/2008
FR 2314684 A * 2/1977 ..... A44C 17/02
(Continued)

OTHER PUBLICATIONS

Morabito Pascal; FR2314684A1 Article of jewelry with precious stone—has transparent setting block which incorporates reflector; Jan. 14, 1977; EPO English Machine Translation; pp. 1-3 (Year: 1977).*

*Primary Examiner* — Bayan Salone
(74) *Attorney, Agent, or Firm* — LESLEY A. WALLERSTEIN, LLC

(57) ABSTRACT

This method refers to the composition of gemstones for the manufacture of jewelry. The composition of gemstones so far is done by holding them by mechanical manner (folds, notches) within sockets, method that hides part of gemstones, reducing the aesthetic result and that exposes to risks of damage and alterations of the gemstones. The proposed method, develops the composition (7) of the gemstones in the socket—opening (4) that is covered laterally, above and below, by transparent—translucent levels (2), (1) and (3) respectively, which additionally do not hide any part of the basic composition, protect against all kinds of damage and highlight the radiant effect (shine) and appearance. The total composition forms a single entity composed only of gemstones.

5 Claims, 5 Drawing Sheets

(56) References Cited

U.S. PATENT DOCUMENTS

Figure 1:
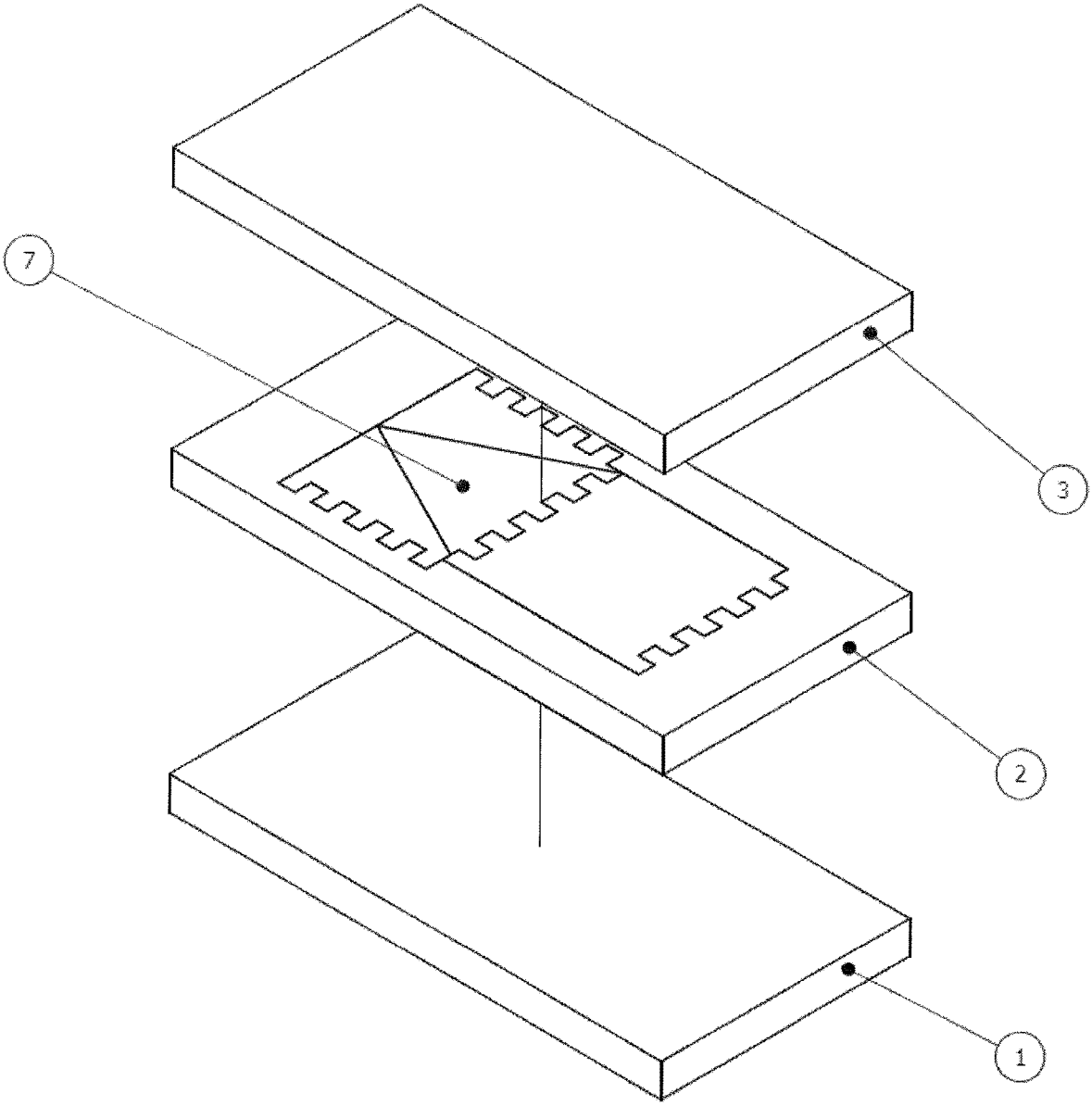

| | | | | |
|---|---|---|---|---|
| 10,362,844 | B2 * | 7/2019 | Bove | G04B 47/044 |
| 2015/0101366 | A1 * | 4/2015 | Liao | G04B 45/0069 63/40 |

FOREIGN PATENT DOCUMENTS

| | | | | | |
|---|---|---|---|---|---|
| GB | 2224632 | A | * | 5/1990 | A44C 17/02 |
| GB | 2258601 | A | * | 2/1993 | A44C 17/02 |
| GB | 2315982 | A | * | 2/1998 | A44C 17/02 |
| JP | 2023533825 | A | * | 6/2021 | A44C 17/0291 |
| RU | 2739177 | C1 | * | 12/2020 | A44C 17/00 |
| WO | WO-2020070667 | A1 | * | 4/2020 | A44C 15/0015 |
| WO | WO-2022013651 | A1 | * | 1/2022 | A44C 17/0291 |

* cited by examiner

METHOD OF GEM COMPOSITION FOR THE MANUFACTURE OF JEWELLERY (CRYSTAL IN CRYSTAL)

In the process of making jewelry with embedded gemstones, the method followed for the attachment of these gemstones on the jewelry is the following: In the case of a solitaire, a separate seat (cell) is formed in metal mesh to welcome the gemstone and support it in its lower facets. Then, to hold the gemstone in its cell, we fold the sides of the metal cell on the upper face of the gemstone, causing its fixation onto the jewelry.

Where the composition includes more than one gemstone, depending on their shapes, a grid of angular sections is created for their precise positioning and holding. The cells formed by the vertical sides of the angular cross-sections have exactly the shape of the gemstones, and the horizontal side of the angular cross-sections is used to accommodate and support these gemstones from below. To hold the gemstones through the cells of the grid, notches—protrusions—folds are created in the upper part of the vertical sides of the angular cross-sections, which overlap part of the upper side of gemstones and in this way hold—stabilize them within the metal cells—sockets.

Disadvantages of the conventional methods outlined above include:

(1) The notches/folds partially cover the gemstone, reducing visibility and brilliance.

(2) The base metal structure is often visible from below, affecting aesthetics.

(3) The lateral parts of the gemstone composition are concealed, limiting visual appeal.

To overcome these drawbacks, the proposed novel method of composite gemstone synthesis is developed with a three-level structure of transparent or translucent gemstone layers (1), (2), and (3). The middle layer (2) has an opening (4) where the gemstones of the basic composition (7) are placed. This ensures that the gemstones are enclosed within the structure without visible metallic elements, allowing light to pass through and maximizing the radiant effect.

The basic composition (7) is developed within the opening (4) and can comprise a single gemstone (solitaire) or multiple gemstones (mosaic tessellation). The gemstones within the composition interact to optimize light reflection and aesthetic presentation.

Here it is noted that the cross-section of the sides of the perimeter (5) can be of any configuration, i.e., straight vertical, straight lines in inclination, curves, or any shape (e.g., I-shaped, etc.). Four of the infinite possible variations of modulation are given in FIG. 5. 11

This socket-opening (4) is the one in which the basic composition of gemstones (7) develops, and it can have any shape: rectangular, quadrate, triangular, polygonal, circular, ellipsoidal, etc. 11

The basic composition of gemstones (7) may consist of one or more gemstones of any shape. These shapes create a tessellation that complements each other and thereby covers the entire surface (6). The tessellation, depending on the desired visual-aesthetic effect, can also be developed along a third axis. This means that the gemstones can complement each other not only in covering the surface but also in covering volume. They may not always be of the same height or equal in extent. In this way, when covering the space defined by the surface (6) and the perimeter (5) (FIG. 3), the placement of the gemstones—which involves the positioning of tiles—will create recesses, gaps, and protrusions that may or may not be covered by the interfaces between the tiles. 11

A critical feature is the groove-slide system (8) formed in the perimeter (5) of the opening (4), which ensures a secure yet seamless retention mechanism without requiring traditional metal prongs or adhesives. Depending on the design, the form of the grooves (8) can be of any cross-sectional shape, such as square, triangular, circular, etc.

The fully enclosed solely gemstone composition is then secured within jewelry through non-invasive methods such as gluing, screws, or mechanical fitting, further enhancing its durability and aesthetic appeal.

This improved synthesis method significantly enhances light dispersion, color reflection, and overall brilliance compared to conventional settings, as it eliminates opaque support structures while maintaining structural integrity.

The following figures illustrate the methodology and design principles:

FIG. 1: Isometric representation of the three gemstone layers.

Figure 2:
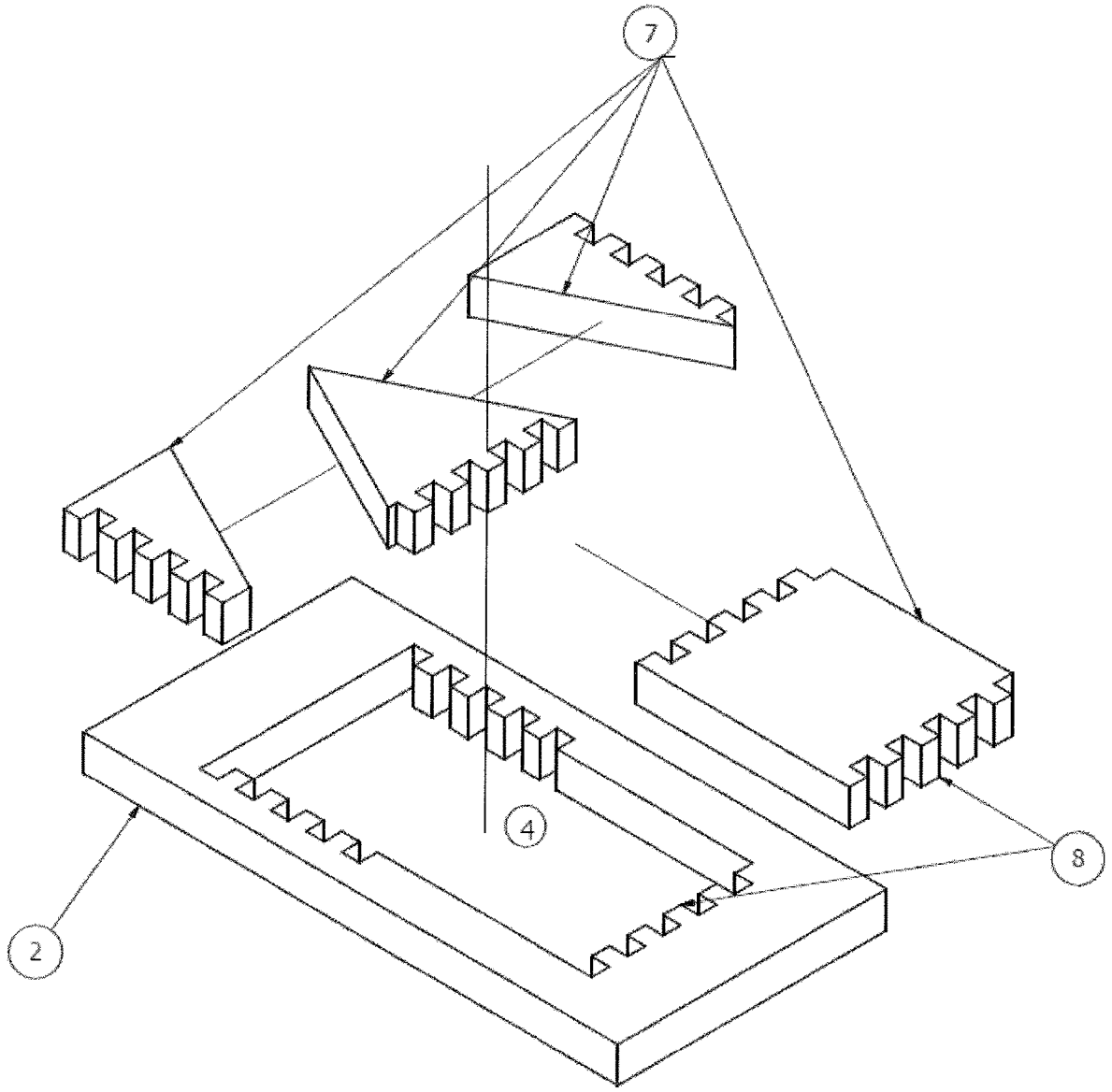

FIG. 2: Configuration of the opening (4) and groove-slide system (8).

Figure 3:
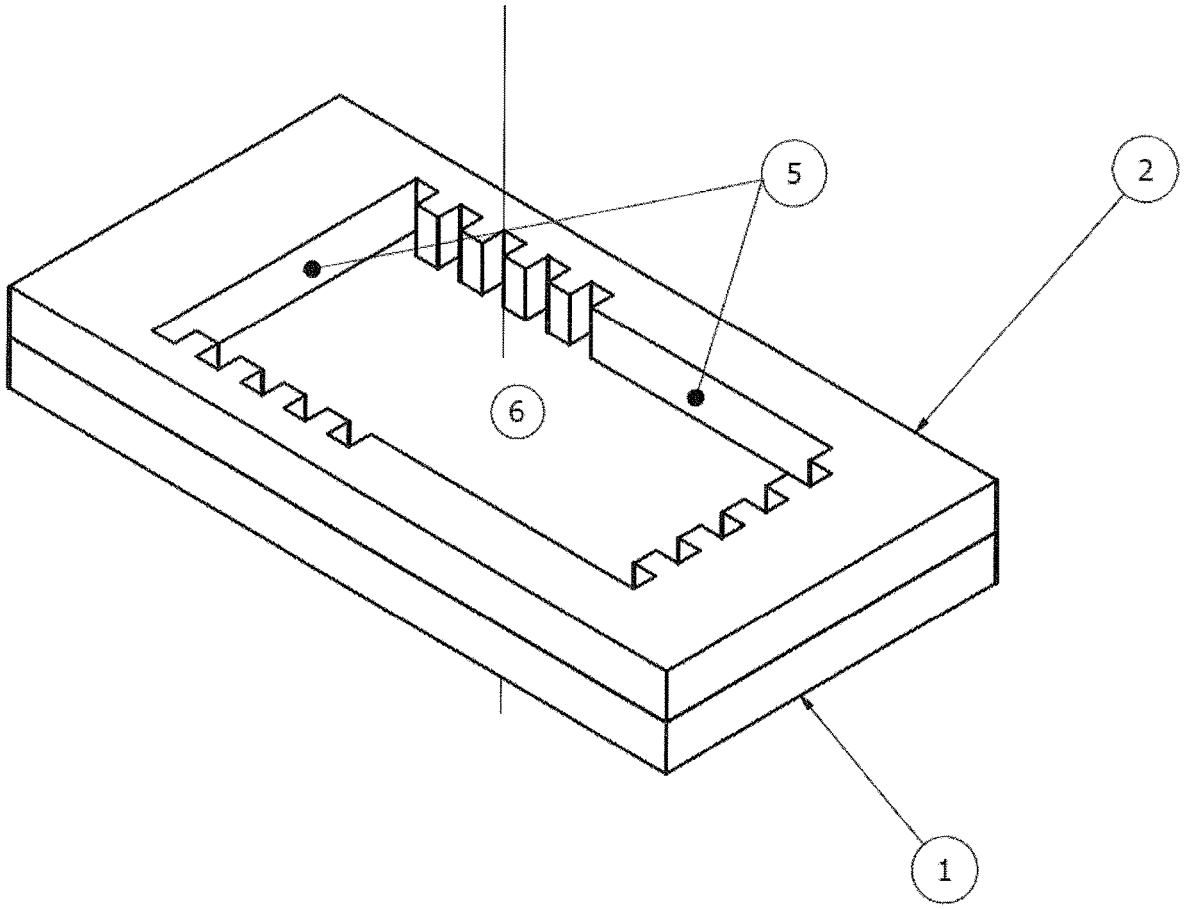

FIG. 3: Cross-sectional illustration of gemstone placement within the opening (4).

Figure 4:
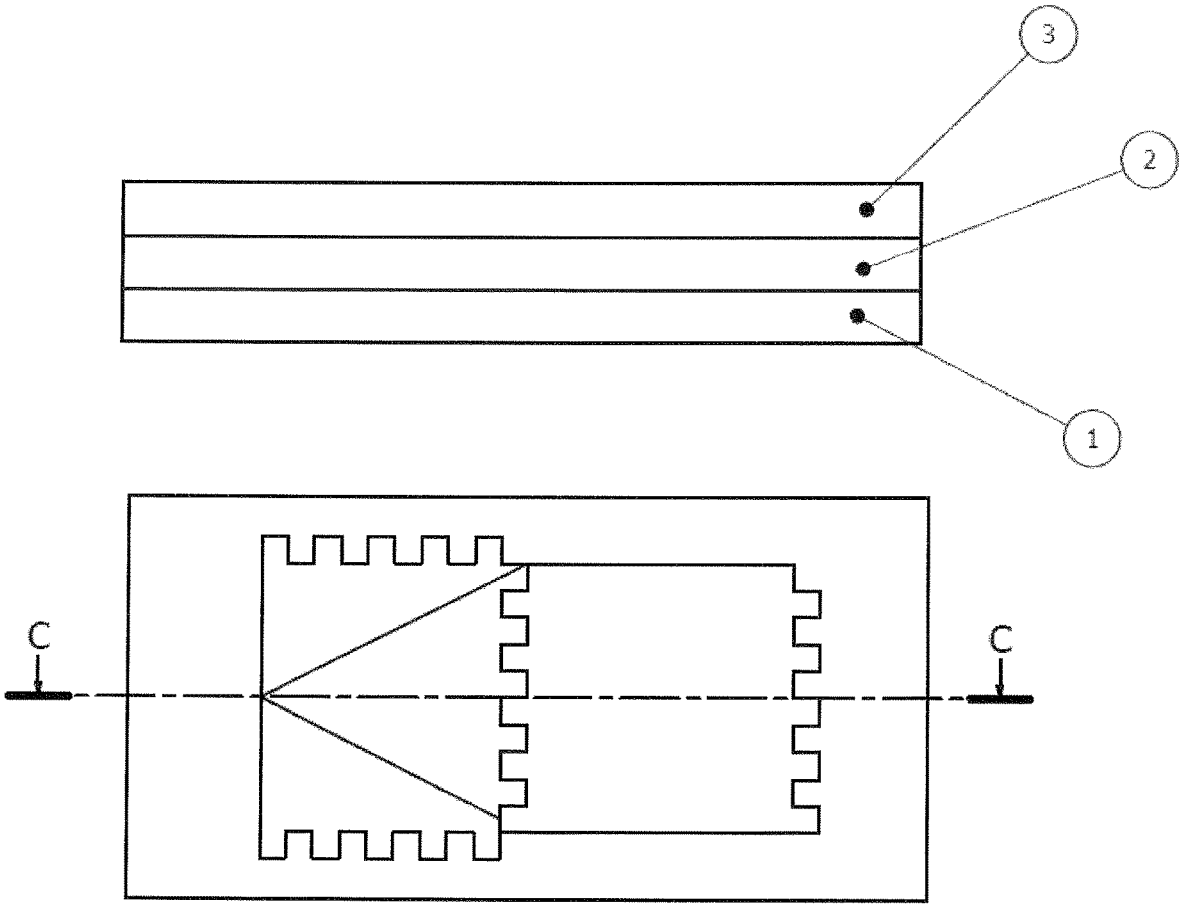

FIG. 4: Side and top views of the multi-level structure.

Figure 5:
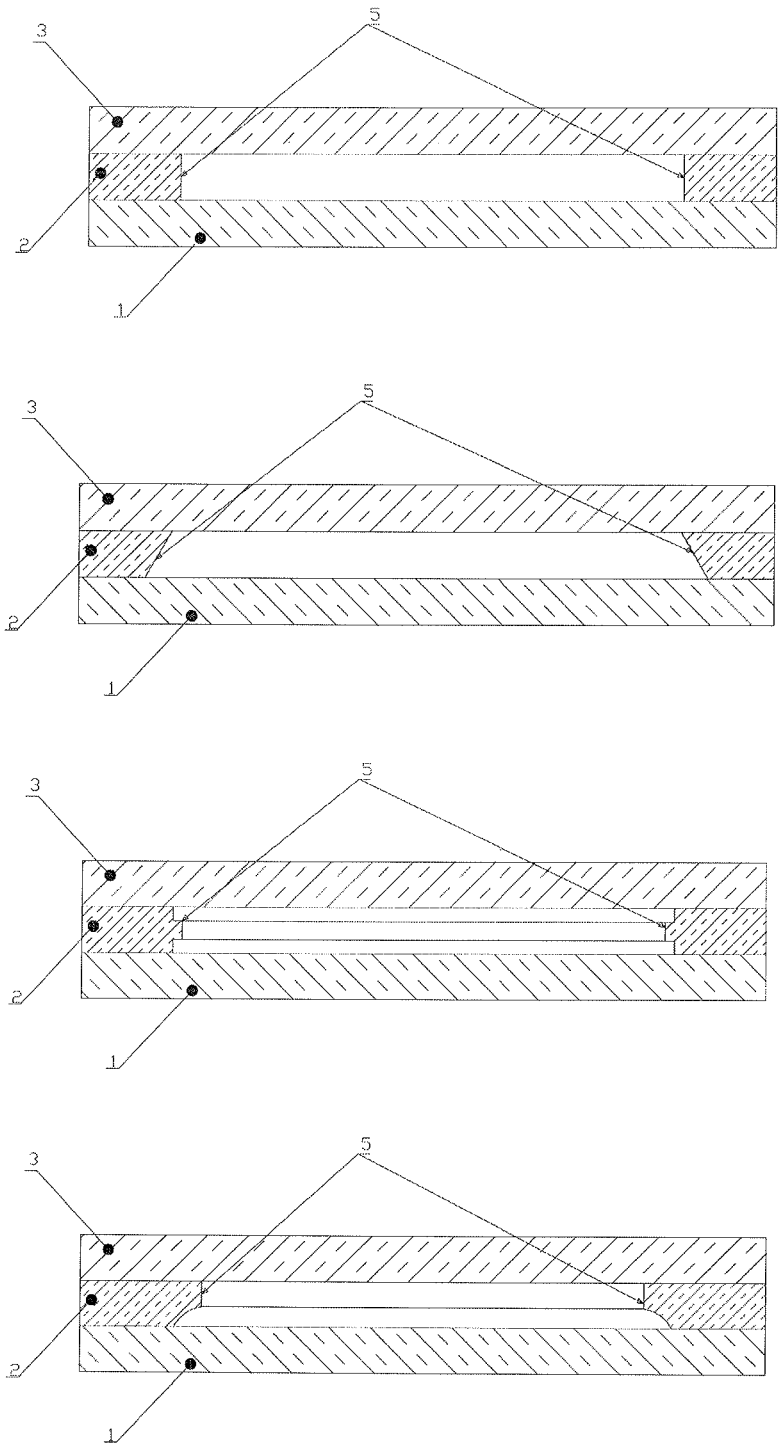

FIG. 5: Variations of the perimeter (5) configurations.

The advantages of this method over traditional settings include:

Enhanced transparency and brilliance as gemstones remain fully visible from all angles.

Improved structural integrity through precision-cut interlocking grooves.

Aesthetic flexibility, allowing designers to create gemstone mosaics or intricate patterns.

This novel gemstone synthesis method provides a revolutionary advancement in jewelry manufacturing, offering superior aesthetic appeal, durability, and artistic versatility compared to existing techniques.

The invention claimed is:

1. A method of gemstone synthesis, comprising the steps of:

a. Constructing a three-level structure with successive transparent or translucent gemstone layers, defined as a first layer, a second layer, and a third layer;

b. Forming an opening in the second layer to accommodate a basic composition of gemstones;

c. Providing a perimeter surrounding the opening in the second layer, the perimeter comprising groove-slide structures for securing gemstones in place;

d. Laterally enclosing and securing the basic composition of gemstones within the groove-slide structures of the second layer, with the first layer and the third layer covering the composition from above and below, respectively; and e. Ensuring full visibility of the basic composition from all sides, without the use of metal-based support elements that would obstruct light transmission.

2. The method of claim 1, wherein the groove-slide structures have a straight vertical, inclined straight line, curved or T-shaped cross-section.

3. The method of claim 2, wherein the basic gemstone composition further comprises a single gemstone in a solitaire setting.

4. The method of claim 2, wherein the basic gemstone composition further comprises multiple gemstones, where each of the multiple gemstones has groove-slide structures that securely and tangentially interlock with each other and with the groove-slide structure of the perimeter of the second layer, thereby forming a mosaic that collectively covers all or part of the opening in the second layer.

5. The method of claim 4, wherein the multiple gemstones forming the mosaic vary in height and wherein the multiple gemstones have recesses, gaps and protrusions, thereby creating an interlocking tessellation.

* * * * *